US005124058A

United States Patent [19]

Corti et al.

[11] Patent Number: 5,124,058

[45] Date of Patent: Jun. 23, 1992

[54] PERFLUOROPOLYETHER LUBRICANTS HAVING ANTIWEAR PROPERTIES

[75] Inventors: Constante Corti; Paolo Savelli, both of Milan, Italy

[73] Assignee: Ausimont S.P.A., Milan, Italy

[21] Appl. No.: 626,137

[22] Filed: Dec. 12, 1990

[30] Foreign Application Priority Data

Dec. 12, 1989 [IT] Italy ..... 22672 A/89

[51] Int. Cl.[5] ..... C07C 43/16; C10M 105/54

[52] U.S. Cl. ..... 252/54; 252/58; 568/615

[58] Field of Search ..... 252/54, 58; 568/615

[56] References Cited

U.S. PATENT DOCUMENTS

| | | | |
|---|---|---|---|
| 3,658,709 | 4/1972 | Christian et al. | 252/54 |
| 3,701,733 | 10/1972 | Smith et al. | 252/54 |
| 4,085,137 | 4/1978 | Mitsch et al. . | |
| 4,757,145 | 7/1988 | Caporiccio et al. . | |
| 4,889,939 | 12/1989 | Caporiccio et al. . | |
| 4,898,991 | 2/1990 | Huang | 568/615 |
| 4,941,987 | 7/1990 | Strepparola et al. . | |
| 4,955,726 | 9/1990 | Bargigia et al. | 252/54 |
| 4,962,236 | 10/1990 | Tatemoto et al. | 252/54 |
| 5,000,864 | 3/1991 | Strepparola et al. . | |

FOREIGN PATENT DOCUMENTS

| | | | |
|---|---|---|---|
| 1285549 | 7/1991 | Canada . | |
| 165649 | 12/1985 | European Pat. Off. . | |
| 322916 | 7/1989 | European Pat. Off. . | |
| 337425 | 10/1989 | European Pat. Off. . | |
| 0344547 | 12/1989 | European Pat. Off. | 568/615 |
| 382224 | 8/1990 | European Pat. Off. . | |
| LU-A-81460 | 7/1979 | Switzerland . | |

*Primary Examiner*—Brian E. Hearn
*Assistant Examiner*—Maria Nuzzolillo
*Attorney, Agent, or Firm*—Morgan & Finnegan

[57] ABSTRACT

This inventions relates to lubricating compositions endowed with high antiwear properties comprising:

A) from 100 to 0.1%, but preferably from 10 to 0.5% by weight of a polyether of general formula:

$$TO(CF_2O)_m(CF_2CF_2O)_n(CF_2\underset{\underset{CF_3}{|}}{C}FO)_s(\underset{\underset{CF_3}{|}}{C}FO)_pT' \quad (I)$$

where:

T, T' either the same or different from each other are inert end groups $-CF_2X$, $-C_2F_4X$, $-C_3F_6X$ or fluorinated reactive end groups containing carboxylic and/or alcoholic and/or ketonic and/or amidic and/or aminic and/or alkoxylic, at least one of T and T' being one of said reactive end groups;

X=F, Cl;

m, n, s, p=integers such that the polyether has an average molecular wieght ranging from 1,000 to 100,000, on conditions that, when none of them is zero, s/p is about 10, s/n ranges from 0.5 to 1.5, n/m is about 10, while when n is zero, s/n is about 10 and s/m is about 20, while when s, p are zero, n/m ranges from 0.6 to 2;

B) from 0 to 99.9%, but preferably from 90 to 99.5% by weight of a perfluoropolyether having non-reactive end groups.

The lubricating compositions, object of the present invention, can be used, with the aid of proper thickening agents, also for the formulation of lubricating greases having high antiwear properties.

7 Claims, No Drawings

PERFLUOROPOLYETHER LUBRICANTS HAVING ANTIWEAR PROPERTIES

FIELD OF THE INVENTION

The present invention relates to compositions based on perfluoropolyether compounds, endowed with lubricating characteristics and improved antiwear properties.

BACKGROUND OF THE INVENTION

From Italian patent application No. 20,322 A/86 it is known the use of fluid perfluoropolyethers endowed with a kinematic viscosity ranging from 8,000 to 40,000 cSt at 20° C.—as lubricating oils or components of perfluorinated lubricating greases in order to obtain lubricants having a low friction coefficient.

In said patent application it is proved that it is not possible to obtain a low friction coefficient from perfluoropolyethers of the straight type endowed with a low kinematic viscosity, for example of 30–250 cSt.

On the other hand it is found that the antiwear properties of a perfluoropolyether cannot be directly correlated to the friction coefficient, as such properties do not improve as the viscosity increases.

Furthermore, from Italian patent application No. 20,159 A/86 there are known several additives for lubricants based on perfluoropolyether compounds, which impart antirust properties to said perfluoropolyethers.

Also in such case these additives seem not to impart particular antiwear properties to the perfluoropolyether lubricants, thereby proving that such properties cannot be directly correlated to the antirust properties.

On the other hand, the antiwear characteristics of the perfluoropolyether lubricants are similar to the ones of the mineral oils and not fully satisfactory for most of the practical applications of the lubricants.

SUMMARY OF THE INVENTION

The applicant has now found that lubricants consisting of fluoropolyethers having general formula:

$$TO(CF_2O)_m(CF_2CF_2O)_n(CF_2\underset{\underset{CF_3}{|}}{C}FO)_s(\underset{\underset{CF_3}{|}}{C}FO)_pT' \qquad (I)$$

or compositions based on perfluoropolyethers as defined hereinafter, containing the fluoropolyethers of formula (I) as additives, exhibit better antiwear properties.

DETAILED DESCRIPTION OF THE INVENTION

In formula (I), the perfluorooxyalkylene units having indexes m, n, s, p are randomly distributed along the chain.

The coefficients m, n, s, p in the structure of formula (I) are integers such that the products comprised in said structure exhibit an average molecular weight in the range from 1,000 to 100,000, but preferably from 2,000 to 5,000. When none of such coefficients is zero, the s/p ratio is of about 10, the s/n ratio ranges from 0.5 to 1.5 and the n/m ratio is of about 10. When n is equal to zero, s/p is about 10, while s/m is about 20; when s, p are equal to zero, n/m ranges from 0.6 to 2.

Perfluorooxyalkylene units of formula ($—CF_2—CF_2—CF_2O$) and/or ($—CF_2CF_2CF_2CF_2O—$) can also be present in the structure of formula (I).

End groups T and T', either the same or different from each other, are comprised in the group of inert end groups of formula $CF_2X—$, $C_2F_4X—$, $C_3F_6X—$ and in the group of fluorinated reactive end groups containing carboxylic, alcoholic, amidic, ketonic, aminic, alkoxylic, among which, for example, are cited the ones of formula:

$$—CF_2COOH,\ —\underset{\underset{CF_3}{|}}{C}F—COOH,\ —CF_2—\underset{\underset{CF_3}{|}}{C}=O,$$

$$—CF_2CONR_1R_2,\ —\underset{\underset{CF_3}{|}}{C}FCONR_1R_2,\ —CF_2—\underset{\underset{CF_3}{|}}{C}\begin{matrix}OH\\OH\end{matrix},$$

$$—CF_2—\underset{\underset{CF_3}{|}}{C}\begin{matrix}OH\\OH.HNR_1R_2\end{matrix},\ —CF_2CH_2OH,$$

$$—\underset{\underset{CF_3}{|}}{C}F—CH_2OH;\ —CF_2\underset{\underset{CF_3}{|}}{C}HOH,\ —CF_2—\underset{\underset{CF_3}{|}}{C}\begin{matrix}Y\\OH\end{matrix},$$

$$—CF_2—COO^-HA^+,\ —\underset{\underset{CF_3}{|}}{C}F—COO^-HA^+$$

wherein:

X=F, Cl;

$R_1$, $R_2$ the same or different from each other, are H or alkyl, alkylaryl, aryl radicals, optionally containing substituents such as, for example, —OH, halogens, or they can form with N a heterocyclic radical, which can contain also other heteroatoms such as O, S, P;

A means a primary, secondary or tertiary amine or a heterocyclic base, optionally containing also other heteroatoms such as O, S, P;

Y=$—OCH_3$, $—NH_2$, $—NR_1R_2$;

on condition that at least one out of T and T' is one of the abovesaid reactive groups; or, when coefficients s, p are zero, T and T', the same or different from each other, are groups $—CF_2—CH_2OH$, $—CF_2—COOH$, $—CF_2—CN$.

The products of structure (I) are obtainable from the precursors of general formula:

$$LO(CF_2O)_m(CF_2CF_2O)_n(CF_2\underset{\underset{CF_3}{|}}{C}FO)_s(\underset{\underset{CF_3}{|}}{C}FO)_pL' \qquad (II)$$

where m, n, s, p, X have the same value as defined hereinbefore, while L and L', the same or different from each other, are comprised in the group of inert end groups of formula $—CXF_2$, $—C_2XF_4$, $—C_3XF_6$ where X=F, Cl and in the group of reactive end groups of formula:

$$—CF_2—COF,\ —\underset{\underset{CF_3}{|}}{C}FCOF,\ —CF_2—\underset{\underset{CF_3}{|}}{C}=O,$$

-continued $$-CF_2-CF_2-COF,\ CF_2OCOF,\ -CF_2\underset{\underset{CF_3}{|}}{C}FOCOF,$$

$$-\underset{\underset{CF_3}{|}}{C}F-CF_2OCOF,$$

at least L or L' being one of such reactive end groups.

In the structure of formula (II), also groups ($-CF_2CF_2CF_2O-$) and/or ($-CF_2CF_2CF_2CF_2O-$) can be present.

The precursors of formula (II) are preparable according to known techniques, by reaction of one or more perhaloolefins, such as e.g. tetrafluoroethylene, hexafluoropropene, chlorotrifluoroethylene, with oxygen in the presence of ultraviolet radiations, at temperatures of from −80° to +40° C., in the presence or in the absence of solvents, and by subsequent heat-treatment, at 200°-250° C., of the products so obtained in order to decompose the peroxide groups (—O—O—), if any, present therein.

In the structure of formula (II), X is F when n has value zero, while when s, p are equal to zero, the reactive end groups are constituted by $-CF_2COF$, and X is F or Cl.

The products of structure (I) can be obtained from those of structure (II) either directly or by reaction of the reactive end groups present in the latter with proper reagents, such as $H_2O$ or amine $NHR_1R_2$, or by further conversion of the resulting groups to yield alcoholic groups, by reduction of the corresponding carboxylic groups, nitrile groups, by dehydration of the corresponding primary amidic groups, and quaternary ammonium carboxylated groups by treatment of the carboxylic groups with amines.

The above-mentioned compounds of formula (I) can be used, besides as such, as additives which promote the antiwear properties in perfluoropolyethers belonging to one of the following classes:

1. $A'O(CF_2-\underset{\underset{CF_3}{|}}{C}FO)_m(CFXO)_n-A$ where X is —F, $-CF_3$; A and A', the same or different from each other, can be $-CF_3$, $-C_2F_5$, $-C_3F_7$. Units ($CF_2CF(CF_3)O$) and (CFXO) are randomly distributed along the perfluoropolyether chain, m and n are integers such that the m/n ratio ranges from 20 to 1,000 and the perfluoropolyether viscosity ranges from 10 to 4,000 cst.

These perfluoropolyethers are obtained by photo-oxidation reaction of hexafluoropropene according to the process described in British patent 1,104,482, and by successive conversion of the end groups into inert groups according to the process described in British patent 1,226,566.

2. $C_3F_7O(\underset{\underset{CF_3}{|}}{C}F-CF_2O)_m-B$ where B can be $-C_2F_5$, $-C_3F_7$, and m is a positive integer such that the product viscosity is in the range of the values indicated above for class 1.

These compounds are prepared by ionic oligomerization of the hexafluoropropene epoxide and successive treatment of acyl fluoride (COF) with fluorine according to the processes indicated in U.S. Pat. No. 2,242,218.

3. $\left[C_3F_7O(\underset{\underset{CF_3}{|}}{C}F-CF_2O)_m-\underset{\underset{CF_3}{|}}{C}F\right]_2$ where m is an integer such that the product viscosity is in the above-specified range.

These products are obtained by ionic telomerization of the hexafluoropropene epoxide and successive photochemical dimerization of acyl fluoride, according to the processes described in U.S. Pat. No. 3,214,478.

4. $A'O[CF_2CF(CF_3)O]_m-(C_2F_4O)_n(CFXO)_qA$ where A and A', the same or different from each other, can be $-CF_3$, $-C_2F_5$, $-C_3F_7$; X is —F, $-CF_3$; m, n and q are integers and can be also equal to 0, but in any case they are such that the perfluoropolyether viscosity is in the range indicated hereinabove.

These products are obtained by photo-oxidation of mixtures of $C_3F_6$ and $C_2F_4$ and successive treatment with fluorine according to the process described in U.S. Pat. No. 3,665,041.

5. $CF_3O(C_2F_4O)_p(CF_2O)_q-CF_3$ where p and q are integers like or different from each other, with the p/q ratio being comprised between 0.1 and 5, and such that the viscosity is in the above indicated range.

These perfluoropolyethers are prepared by photochemical oxidation of $C_2F_4$ according to U.S. Pat. No. 3,715,378 and subsequent treatment of the photo-oxidation product with fluorine according to U.S. Pat. No. 3,665,041.

6. $AO-(CF_2-CF_2-CF_2O)_m-A'$ where A and A', the same or different from each other, can be $-C_2F_5$, $-C_3F_7$, and m is an integer such that the product viscosity is in the range of the above-indicated values.

These products are obtained according to European patent No. 148,482.

7. $DO-(CF_2-CF_2O)_rD'$ where D and D', the same or different from each other, can be $-CF_3$, $-C_2F_5$, and r is an integer such that the product viscosity is in the abovesaid range of values. These products are prepared according to U.S. Pat. No. 4,523,039.

8. $R'_f-\left(\begin{array}{c} CF_3 \\ | \\ C \\ | \\ CF_3 \end{array}-O-\begin{array}{c} R_f \\ | \\ C \\ | \\ R_f \end{array}-\begin{array}{c} R_f \\ | \\ C \\ | \\ R_f \end{array}-O\right)_n-R'_f$ where $R'_f$ is a perfluoroalkyl, n is at least 8, $R_f$ is F or a perfluoroalkyl.

These perfluoropolyethers are described in PCT patent application WO 87/00538.

Other basic fluids, which can be additioned with the compounds of formula (I), can be, besides the ones cited hereinbefore, paraffinic and/or aromatic mineral oils, polyolefins, siliconic and fluosiliconic fluids, and polyphosphazenes.

The perfluoropolyethers of classes from 1 to 8 cited hereinbefore have perfluoroalkyl inert end groups, are liquid with a very low vapor tension and exhibit a viscosity, at 20° C., generally ranging from 50 to 100,000 cSt, preferably from 100 to 2,000 cSt. The above described products of formula (I) are soluble in these fluids.

Thus, object of the present invention is the use, as antiwear lubricants, of compositions comprising from 100 to 0.1%, but preferably from 10 to 0.5% by weight of a polyether of formula (I) cited above, and from 0 to 99.9%, but preferably from 90 to 99.5% by weight of a perfluoropolyether (basic fluid) belonging at least to one of classes 1 to 8 illustrated hereinbefore.

EXAMPLES

The following examples are given to illustrate but not to limit the scope of the present invention.

Said examples refer to the characterization of lubricating oils comprising perfluoropolyethers of the above cited classes 1 to 8 and/or fluoropolyethers of general formula (I).

The lubricating oils of such examples, consisting of, or containing or not containing the perfluoropolyethers of said formula (I), have been characterized, as regards their antiwear properties, by means of the four ball wear machine, ASTM D 4172B method, under those operative conditions, under which a mixed lubrication occurs.

SUMMARY OF THE UTILIZED MEASUREMENT METHOD

Three steel balls (0.5 in. diameter) were fixed in a proper container and coated with the lubricant to be evaluated.

A fourth ball of the same type as the preceding ones and placed above them in order to have three contact points, was rotated, under a prefixed load, for a predetermined time. The lubricant was thermoregulated at a given temperature.

The behaviours of the lubricants were compared on the basis of the average wear diameter of the fixed balls.

APPARATUS

The test apparatus comprises an electric motor and a pulley system which permits to operate at different speeds of rotation. A spindle, which contains the upper test-piece consisting of a steel ball (0.5 in. diameter) is integral with the driven shaft.

In a container, placed in proximity of the rotating ball, there are arranged three further balls identical, as to diameter and material, with the preceding ball, and fixed and immersed in the lubricant.

The variable load, applicated from down upward, pushes the underlying balls against the ball integral with the spindle.

The load is applicated by means of a level system.

An induction heating device keeps constant the lubricant temperature in the inside of the container; a thermocouple is arranged therein.

Once the prefixed lubricant temperature has been reached, the prefixed load has been applicated and the shaft speed of rotation has been selected, the test is started and carried on for the predetermined time.

TEST CONDITIONS

The reported results refer to tests carried out under the following conditions:

load: 40 kg
temperature: 75° C.
speed of rotation: 1200 r.p.m.
time: 60 minutes.

PREPARATION OF THE BALLS

The balls, of the chrome steel type, made of AISI steel Standard No. E-52100, having a diameter of 0.5 in., grade 25 EP (Extra Polish), were cleaned and degreased by immersion first in n-hexane (15 minutes), then in Delifrene HP (trichlorotrifluorethane) (15 minutes), at last dried with anhydrous air.

WEAR EVALUATION

On conclusion of the test and without removing the three fixed (lower) balls from the housing, by means of a microscope having a sensitivity of 0.01 mm, the wear was measured for each ball; for each ball, after having removed the oil from the housing by letting it drop for 15 minutes and having washed in particular the wear area with Delifrene HP, two diameters of the wear impression produced on the surface in consequence of rotation were measured, one diameter in the direction of rotation and the other diameter perpendicularly to the former (6 detections); then, the average of the values was made, so obtaining the result of the test, which is the average wear diameter (mm).

EXAMPLES 1-5

Compositions were prepared by using, as basic fluids, perfluoropolyethers having different viscosities, belonging to class 1, of formula:

$$A'O\left(CF_2-\underset{\underset{CF_3}{|}}{CFO}\right)_m(CFXO)_nA,$$

where $X=CF_3$, F

A; $A'=CF_3$, $C_2F_5$, $C_3F_7$ $m/n=20$ and, as additives, fluoropolyethers having different average molecular weights, of formula:

$$CF_3O-(CF_2O)_m(CF_2\underset{\underset{CF_3}{|}}{C}FO)_s(\underset{\underset{CF_3}{|}}{C}FO)_pT, \text{ where}$$

$$T = CF_2-C\begin{matrix}OH\\OH\end{matrix}-CF_3\ (75\%);\ CF_2-COOH\ (25\%)$$

$s/p = 10$; $s/m = 20$; $p/m = 2$.

Such compositions were prepared by mixing the basic fluids with the additives.

The characteristics of each basic fluid and of the additive, their amounts in the composition and the value of the average wear diameter relating to each composition are reported in table 1.

TABLE 1

| EXAMPLES | BASIC FLUID Viscosity at 20° C. (cSt) | BASIC FLUID % by wg. | ADDITIVE M.W. | ADDITIVE % by wg. | RESULT average wear diameter (mm) |
|---|---|---|---|---|---|
| 1 | 250 | 95 | 2400 | 5 | 0.50 |
| 2 | 250 | 95 | 2100 | 5 | 0.57 |
| 3 | 250 | 90 | 2400 | 10 | 0.64 |
| 4 | 450 | 97 | 4150 | 3 | 0.60 |
| 5 | 1200 | 95 | 4150 | 5 | 0.60 |

EXAMPLE 6

The determination of the antiwear properties was carried out only on the additive of example 1, not mixed with any basic fluid.

The average wear diameter was equal to 0.65 mm.

EXAMPLE 7

Example 1 was repeated, but using, as an additive, the compound of formula:

$$CF_3O-(CF_2O)_m(CF_2-\underset{\underset{CF_3}{|}}{C}FO)_s(\underset{\underset{CF_3}{|}}{C}FO)_pT,$$

where: s/p = 10; s/m = 20; p/m = 2

$$T = CF_2-C(OH)_2-CF_3 \text{ (75\% by mols);}$$

$$-CF_2-COO^-NH^+(CH_2-CH_2OH)_3 \text{ (25\% by mols)}$$

having an average molecular weight of about 2,400, and in an amount equal to 6% by weight referred to the mixture with the basic fluid.

The average wear diameter was equal to 0.48 mm.

EXAMPLES 8-9

There were determined the antiwear properties of compositions consisting of the basic fluid of class 1 with an additive of formula:

$$CF_3O-(CF_2O)_m(CF_2-\underset{\underset{CF_3}{|}}{C}FO)_s(\underset{\underset{CF_3}{|}}{C}FO)_pT,$$

where: s/p = 10; s/m = 20; p/m = 2

$$T = CF_2-C(OH)_2-CF_3 \text{ (75\% by mols);}$$

$$-CF_2-CONH_2 \text{ (25\% by mols).}$$

The characteristics of the compositions and the results of the wear tests are reported in table 2.

TABLE 2

| EX. | BASIC FLUID Viscosity at 20° C. (cSt) | BASIC FLUID % by wg. | ADDITIVE Average molecular wg. | ADDITIVE % by wg. | RESULT Average wear dia. (mm) |
|---|---|---|---|---|---|
| 8 | 250 | 95 | 2,400 | 5 | 0.50 |
| 9 | 450 | 97 | 2,400 | 3 | 0.56 |

EXAMPLES 10-12

There were evaluated the antiwear properties of the perfluoropolyethers of class 1, used as basic fluids in examples 3, 4 and 5, without additives. The found average wear diameters were 0.85, 0.78 and 0.73 mm, respectively.

EXAMPLES 13-14

There were determined the antiwear properties of compositions consisting of basic fluids of classes 4 and 5, respectively:

$$A'O\left(CF_2-\underset{\underset{CF_3}{|}}{C}FO\right)_m(CF_2-CF_2O)_n(CFXO)_qA.$$

where:

X=F, $CF_3$ m/n=1.5; m/q=15

A, A', the same or different from each other, are $-CF_3$ and/or $-C_2F_5$ and/or $-C_3F_7$, having a kinematic viscosity at 20° C. equal to 250 cSt and an average molecular weight of 4,000, and $$CF_3O(CF_2CF_2O)_p(CF_2O)_qCF_3$$

where:

p/q=1, having a kinematic viscosity at 20° C. equal to 150 cSt and an average molecular weight of 7,850, and of 5% by weight of the same additive of example 1.

The wear tests on the two compositions gave values of the average diameter equal to 0.53 and 0.70 mm, respectively.

EXAMPLE 15

There were determined the antiwear properties of a composition consisting for 95% by weight of the perfluoropolyether (basic fluid) of example 14, and for 5% by weight of an additive mixture having a kinematic viscosity at 20° C. equal to 80 cSt, consisting for 97% by weight of the compound of formula:

$$HOCH_2-CF_2-Rf-CF_2-CH_2OH$$

and for 3% by weight of the compound of formula:

$$HOOC-CF_2-Rf-CF_2-COOH$$

where: Rf=perfluoropolyethereal chain having an average molecular weight equal to 2,000 and structure $$O(-CF_2CF_2O)_n(CF_2O)_m$$

where n/m is equal to 0.7.

The average wear diameter was equal to 0.64 mm.

EXAMPLES 16-17

The antiwear properties of the perfluoropolyethers used as basic fluids in examples 13 and 14 (classes 4 and 5, respectively), without addition of additives, were evaluated.

The average wear diameter was equal to 0.90 and 0.92 mm, respectively.

EXAMPLES 18-19

Comparison Tests

In these two examples there were determined the antiwear properties of a perfluoropolyether of the type of class 5, having a kinematic viscosity, at 20° C., equal to 250 cSt, additioned with 2% by weight of fluorinated phosphine of formula:

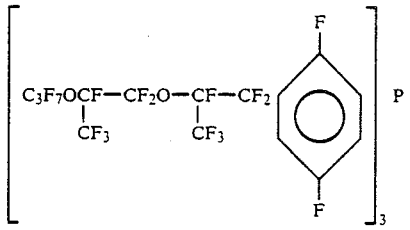

(a conventional stabilizer for perfluoropolyethers), and the antiwear characteristics of the same perfluoropolyether, but without additive.

The first example provided an average wear diameter of 1.52 mm, the second example, an average wear diameter of 0.94 mm.

EXAMPLE 20

Comparison Test

A composition was prepared, which comprised 97% by weight of a basic fluid consisting of the perfluoropolyether of example 1 and 3% of an additive mixture composed for 97% by weight of a compound of formula:

$$NC—CF_2—Rf—CF_2—CN$$

and for 3% by weight of a compound of formula:

$$HOOC—CF_2—Rf—CF_2—COOH$$

where: Rf=perfluoropolyethereal chain having an average molecular weight equal to 2,000, having the structure defined in example 15.

Said additive mixture is described in Italian patent application No. 20,183 A/88, in the name of the Applicant, as a mixture capable of imparting antirust properties to the perfluoropolyether of the present example.

The resulting average wear diameter was equal to 1.04 mm.

EXAMPLE 21

Example 1 was repeated using, as an additive, the compound of formula:

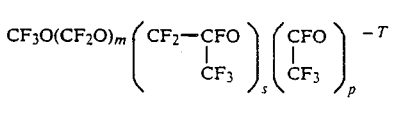

where s/p=10, s/m=20, p/m=2

T=$CF_2$—COOH having an average molecular weight of about 5,000 and in an amount equal to 2% by weight referred to the mixture with the basic fluid.

The average wear diameter was equal to 0.69 mm.

EXAMPLE 22

There were evaluated the antiwear properties of compositions consisting of the basic fluid of example 1, using, as an additive, the compound of formula:

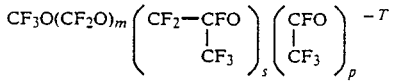

where s/p=10, s/m=20, p/m=2

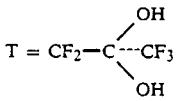

having an average molecular weight equal to 2,100.

Compositions containing 2% and 4% by weight of the additive on the mixture with the basic fluid were evaluated; the average wear diameter was equal to 0.49 mm for both additive concentrations taken into examination.

EXAMPLE 23

There were determined the antiwear properties of a grease prepared according to Italian patent No. 1,151,732, containing, as a basic fluid, the perfluoropolyether of class 1 described in examples 1 to 5, having a kinematic viscosity of 1,500 cSt at 20° C. (66.5% by weight), as an additive, the additive described in examples 1 to 5, having an average molecular weight equal to 2,250 (3.5% by weight) and, as a thickening agent, polytetrafluoroethylene (PTFE) such as Algoflon L 206 (produced by the Applicant) (30% by weight).

The average wear diameter was equal to 0.98 mm.

EXAMPLE 24

According to the technology cited in example 23, a grease was prepared by using, as a basic fluid, only the additive used in example 23 (70% by weight) and, as a thickening agent, PTFE type Algoflon L 206 (30% by weight).

On the grease, the antiwear properties and the average wear diameter, which was equal to 0.70 mm, were determined.

EXAMPLE 25

According to the technology of example 23, a grease containing, as a basic fluid, the same perfluoropolyether used in example 23 (67.8%) and, as an additive, the same additive (2.2% by weight) described in example 15, was prepared. As a thickener for the formulation of the grease, PTFE type Algoflon L206 was used.

From the wear test carried out on the grease so prepared, a value of the average diameter equal to 0.96 mm was obtained.

EXAMPLE 26

Comparison Test

There were determined the antiwear properties of a grease prepared as is described in example 23, containing, as a basic fluid, the same perfluoropolyether of example 23 and, as a thickener, PTFE type Algoflon L206.

The average wear diameter was equal to 1.4 mm.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

We claim:

1. An antiwear lubricant composition comprising:

A. from 100 to 0.1% by weight of a polyether of formula:

$$TO(CF_2O)_m(CF_2CF_2O)_n\left(CF_2\underset{\underset{CF_3}{|}}{C}FO\right)_s\left(\underset{\underset{CF_3}{|}}{C}FO\right)_p-T' \quad (I)$$

where:

T,T' the same or different from each other, are comprised in the inert end groups of formula $-CF_2X$, $-C_2F_4X$, $-C_3F_6X$ and in the fluorinated reactive end groups containing carboxylic, alcoholic, ketonic, amidic, aminic and/or alkoxylic groups, provided that at least one of T and T' is one of said reactive end groups;

X=F, Cl;

m, n, s, p are such integers that the polyethers have an average molecular weight ranging from 1,000 to 100,000, provided that when none of said coefficient is zero, s/p is about 10, s/n ranges from 0.5 to 1.5 and n/m is about 10, while when n is equal to zero, s/p is about 10 and s/m is about 20, while when s, p are equal to zero, n/m ranges from 0.6 to 2;

B. from 0 to 99.9% by weight of a perfluoropolyether belonging at least to one of classes from 1 to 8:

1. $A'O(CF_2\underset{\underset{CF_3}{|}}{C}FO)_m(CFXO)_n-A$ where X is —F, $-CF_3$; A and A', the same or different from each other, are $-CF_3$, $-C_2F_5$, $-C_3F_7$ and the units $(CF_2CF(CF_3)O)$ and (CFXO) are randomly distributed along the perfluoropolyether chain, m and n are integers such that the m/n ratio ranges from 20 to 1,000 and the perfluoropolyether viscosity ranges from 10 to 4,000 cst;

2. $C_3F_7O(\underset{\underset{CF_3}{|}}{C}F-CF_2O)_m-B$ where B is $-C_2F_5$, $-C_3F_7$, and m is a positive integer such that the product viscosity is in the range of the values indicated above for class 1;

3. $\left[C_3F_7O(\underset{\underset{CF_3}{|}}{C}F-CF_2O)_m-\underset{\underset{CF_3}{|}}{C}F\right]_2$ where m is an integer such that the product viscosity is in the above-specified class 1 range;

4. $A'O[CF_2CF(CF_3)O]_m-(C_2F_4O)_n(CFXO)_qA$ where A and A', the same or different from each other, are $-CF_3$, $-C_2F_5$, $-C_3F_7$; X is —F, $-CF_3$; m, n and q are integers and can be equal to 0, but in any case they are such that the perfluoropolyether viscosity is in the range indicated for class 1 hereinabove:

5. $CF_3O(C_2F_4O)_p(CF_2O)_q-CF_3$ where p and q are integers like or different from each other, with the p/q ratio being in the range of between 0.1 and 5, and such that the viscosity is in the above indicated range for class 1;

6. $AO-(CF_2-CF_2-CF_2O)_m-A'$ where A and A', the same or different from each other, are $-C_2F_5$, $-C_3F_7$, and m is an integer such that the product viscosity is in the range of the above-indicated class 1 values;

7. $DO-(CF_2-CF_2O)_rD'$ where D and D', the same or different from each other, are $-CF_3$, $-C_2F_5$, and r is an integer such that the product viscosity is in the abovesaid class 1 range of values;

8. $R'_f-\left(\underset{\underset{CF_3}{|}}{C}-O-\underset{\underset{R_f}{|}}{\underset{\underset{R_f}{|}}{C}}-\underset{\underset{R_f}{|}}{\underset{\underset{R_f}{|}}{C}}-O\right)_n-R'_f$ where $R'_f$ is a perfluoroalkyl, n is at least 8, $R_f$ is F or a perfluoroalkyl.

2. A composition according to claim 1, comprising polyether A of formula (I) in amounts ranging from 0.5 to 10% by weight, and perfluoropolyether B. in amounts ranging from 99.5 to 90% by weight.

3. A composition according to claim 1, wherein the polyether of formula (I) has an average molecular weight ranging from 2,000 to 5,000.

4. A lubricating grease composition having high antiwear properties comprising at least one composition according to claim 1 and a thickening agent.

5. A lubricating grease composition according to claim 4, wherein the thickening agent consists of polytetrafluoroethylene.

6. A method of lubricating a surface comprising lubricating said surface utilizing a lubricating composition containing at least one antiwear lubricant composition according to claim 1.

7. A method of lubricating a surface comprising lubricating said surface utilizing a lubricating grease composition containing at least one antiwear lubricant grease composition according to claim 4.

* * * * *